US005713614A

United States Patent [19]

Anderson

[11] Patent Number: 5,713,614

[45] Date of Patent: Feb. 3, 1998

[54] DOOR LATCH HANDLE EXTENSION AND METHOD OF IMPROVING A DOOR LATCH ASSEMBLY

[76] Inventor: Lee A. Anderson, P.O. Box 797, Zolfo Springs, Fla. 33890

[21] Appl. No.: 710,104

[22] Filed: Sep. 11, 1996

[51] Int. Cl.[6] ..... E05B 3/00

[52] U.S. Cl. ..... 292/336.3; 292/347; 292/DIG. 2; 16/114 R

[58] Field of Search ..... 16/114 R, 115, 16/111 R, DIG. 30; 292/336.3, 347, DIG. 2

[56] References Cited

U.S. PATENT DOCUMENTS

| | | | |
|---|---|---|---|
| D. 295,717 | 5/1988 | Driscoll . | |
| 1,609,117 | 11/1926 | Hansen | 292/DIG. 2 |
| 2,058,685 | 10/1936 | Haan, Jr. | 292/347 |
| 2,699,809 | 1/1955 | Nebe et al. | 292/DIG. 2 |
| 3,317,231 | 5/1967 | Lindquist et al. . | |
| 3,575,453 | 4/1971 | Hohl | 292/336.3 |
| 4,006,927 | 2/1977 | Recupero . | |
| 4,101,153 | 7/1978 | Dozier | 292/336.3 |
| 4,223,931 | 9/1980 | Neary | 16/114 R |
| 4,285,536 | 8/1981 | McCoy et al. | 292/336.3 |
| 4,440,517 | 4/1984 | Potter et al. | 16/115 |
| 4,783,883 | 11/1988 | Szalay | 292/347 |
| 4,877,277 | 10/1989 | Leopoldi | 292/347 |
| 4,913,479 | 4/1990 | Allison | 292/347 |
| 4,941,232 | 7/1990 | Decker et al. | 16/111 R |
| 4,971,375 | 11/1990 | Grecco | 16/114 R |
| 4,979,238 | 12/1990 | Clark | 16/114 R |
| 5,231,731 | 8/1993 | Jones, Jr. | 16/114 R |
| 5,288,116 | 2/1994 | Donofrio . | |

FOREIGN PATENT DOCUMENTS

| | | | |
|---|---|---|---|
| 2066136 | 7/1981 | United Kingdom | 16/114 R |

OTHER PUBLICATIONS

Hints from the Model Garage, Popular Science, Jun. 1961, p. 184, Jun. 1961.

*Primary Examiner*—Rodney M. Lindsey
*Attorney, Agent, or Firm*—Charles J. Prescott

[57] ABSTRACT

A flexible handle extension for a pivoted handle of a light-duty door latch assembly of a screen door and the like and a method of substantially reducing an opening force required to unlatch the assembly from the door jam. The handle extension includes an elongated semi-flexible tube sized in inner diameter to biasingly slidably engage over and be self-retaining on the handle and sized in length to be at least twice the length of the handle. The combination of handle extension length and semi-flexibility substantially reduces door opening force while diminishing the seriousness of body injury when the handle and attached handle extension are accidentally bumped or struck by an individual.

2 Claims, 2 Drawing Sheets

FIG. 3
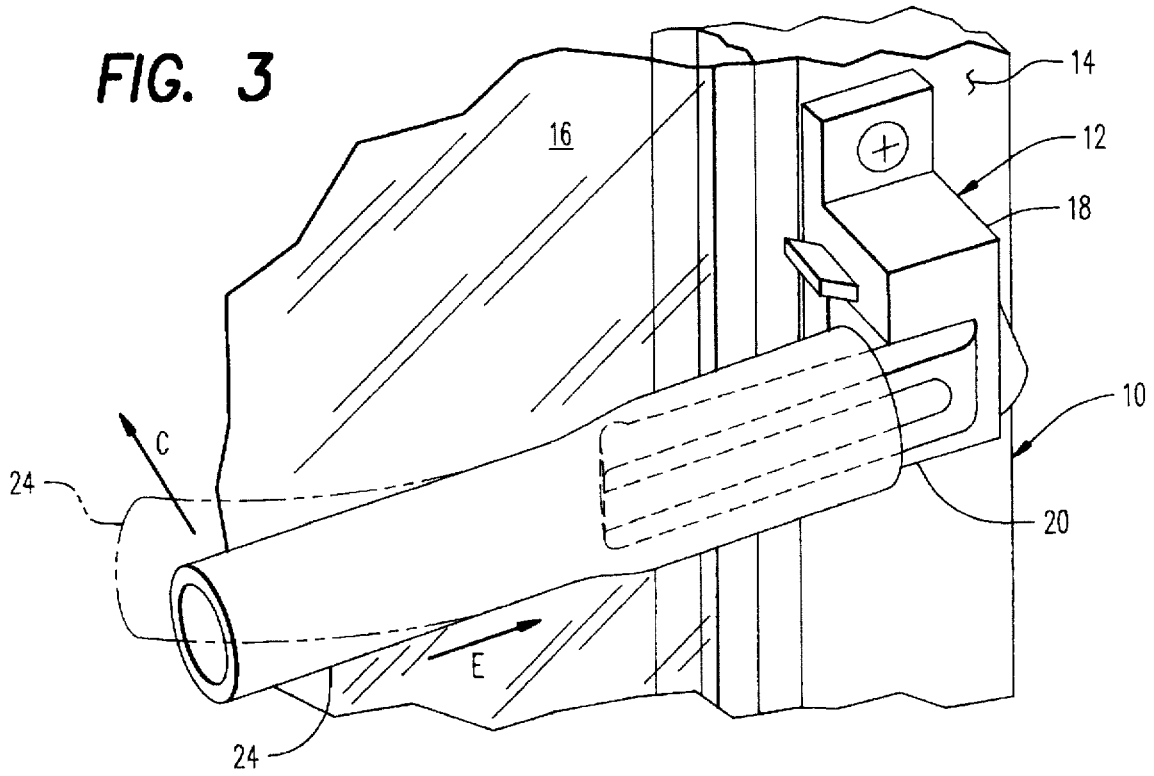
FIG. 4
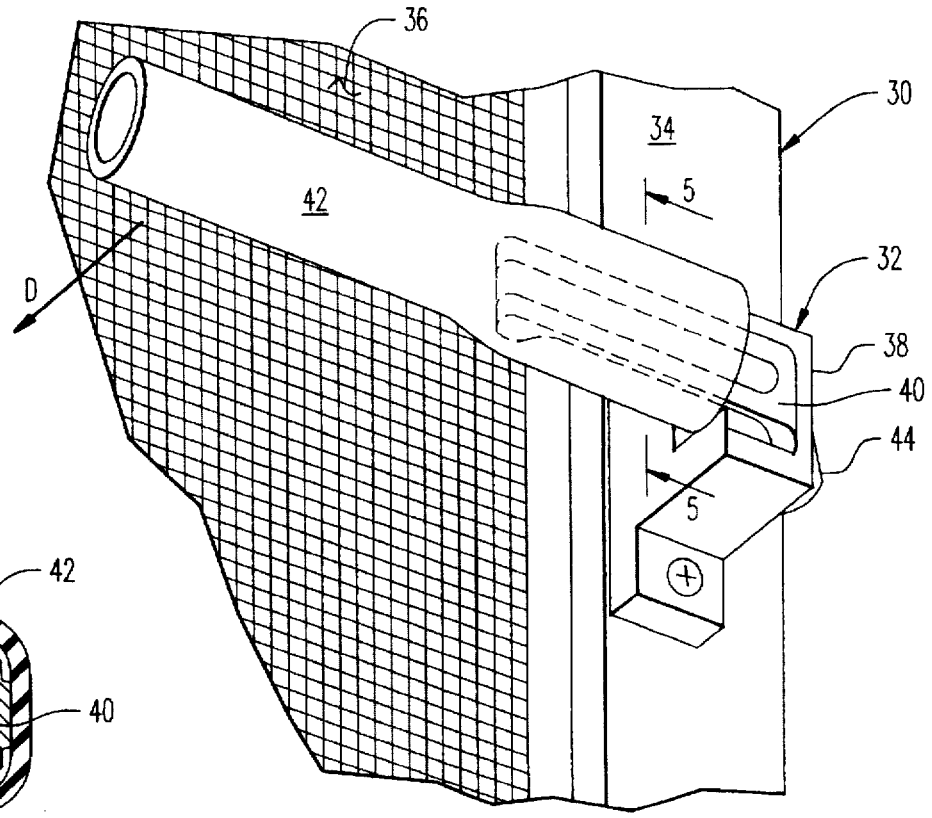
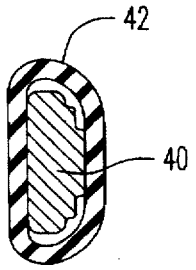
FIG. 5

DOOR LATCH HANDLE EXTENSION AND METHOD OF IMPROVING A DOOR LATCH ASSEMBLY

BACKGROUND OF THE INVENTION

1. Scope of Invention

This invention relates generally to door latch mechanisms and more particularly to improving the ease of opening a light-duty door latch mechanism for screen doors and the like.

2. Prior Art

Door latch assemblies utilized for screen doors and porch, patio, and lanai doors are typically designed and manufactured in an inexpensive manner. This is primarily due to the fact that the security aspect of such door locks is unimportant, the primary purpose of such light-duty door latch assemblies being to keep the door in a closed position against wind, small children, animals and the like.

Because of the economy of the design and manufacture of these light-duty door latch mechanisms, the cast materials involved are of very imprecise dimensions and surface finish so that the interacting components between the pivotally connected handle and the latch itself which disengages from the door jam do not always operate smoothly and evenly. As a result, the relatively short length of handle provided for opening these light-duty door latch assemblies, in combination with high internal frictional resistance to movement, renders opening of the latch assembly somewhat difficult and erratic, increasing with age and wear.

Applicant is unaware of any prior art devices which facilitate or multiply effort in opening pivotally mounted door latch assembly handles of the light-duty type. However, Lindquist in U.S. Pat. No. 3,317,231 teaches an extension door handle for assisting a child in depressing a door latch button inwardly. Likewise, Recupero, in U.S. Pat. No. 4,006,927 teaches a door handle attachment for a screen door handle which multiplies the applied force to inwardly depress the release button of this door latch assembly.

In U.S. Des. Pat. No. 295,717, Driscol teaches a handle extension attachable to a motor vehicle door handle which somewhat addresses the need for force multiplication in opening such vehicle doors.

The following U.S. Patents teach devices or attachments which both eliminate the need for a strong grip and increase or multiply force or effort in rotating a door knob into an open position for latch release.

| | |
|---|---|
| McCoy, et al. | 4,285,536 |
| Jones, Jr. | 5,231,731 |
| Grecco | 4,971,375 |
| Donofrio | 5,288,116 |
| Szalay | 4,783,883 |

The present invention teaches a handle extension easily installable onto the relatively short handles of light weight door latch assemblies for screen doors and the like, which handle is pivotally connected within the door latch housing for either downward pivoting or inward pivoting to effect latch disengagement.

BRIEF SUMMARY OF THE INVENTION

This invention is directed to a flexible handle extension for a pivoted handle of a light-duty door latch assembly of a screen door and the like and a method of substantially reducing an opening force required to unlatch the assembly from the door jam. The handle extension includes an elongated semi-flexible tube sized in inner diameter to biasingly slidably engage over and be self-retaining on the handle and sized in length to be at least twice the length of the handle. The combination of handle extension length and semi-flexibility substantially reduces door opening force required, while diminishing the seriousness of bodily injury or bruising when the handle and attached handle extension are accidentally bumped or struck by an individual.

It is therefore an object of this invention to provide a handle extension for light-duty door assemblies for screen doors and the like which are typically difficult to open.

It is yet another object of this invention to provide a handle extension for light-duty door latch assemblies for screen doors and the like having a pivotally actuated handle.

It is yet another object of this invention to teach an improved light-duty door latch assembly for screen doors and the like which includes a flexible handle extension fitted onto the relatively short opening handle to reduce the level of effort required to disengage the latch.

It is still another object of this invention to provide a method of improving the ease of openability of light-duty door latch assembly for screen doom and the like which have a pivotally actuated handle to disengage its latch.

Another object of the invention is to substantially reduce or diminish the potential level of bodily injury or bruising to an individual who inadvertently bumps or impacts against a door latch assembly having a pivotally actuated handle.

In accordance with these and other objects which will become apparent hereinafter, the instant invention will now be described with reference to the accompanying drawings.

BRIEF DESCRIPTION OF THE DRAWINGS

FIG. 3 is a broken perspective view similar to that of FIG. 1 showing the invention in position.

FIG. 4 is a broken perspective view similar to that of FIG. 2 showing the invention in position.

FIG. 5 is a section view in the direction of arrows 5—5 in FIG. 4.

DETAILED DESCRIPTION OF THE INVENTION

Figure 1:
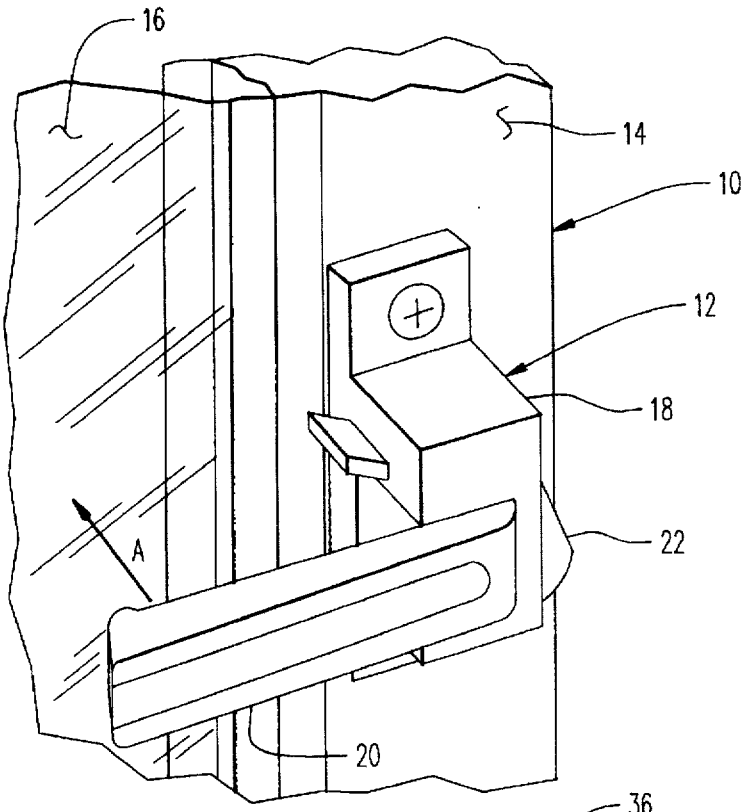
FIG. 1 (PRIOR ART)
FIG. 1 is a broken perspective view of a typical light-duty door latch assembly connected onto a glass lanai or patio door.
Figure 2:
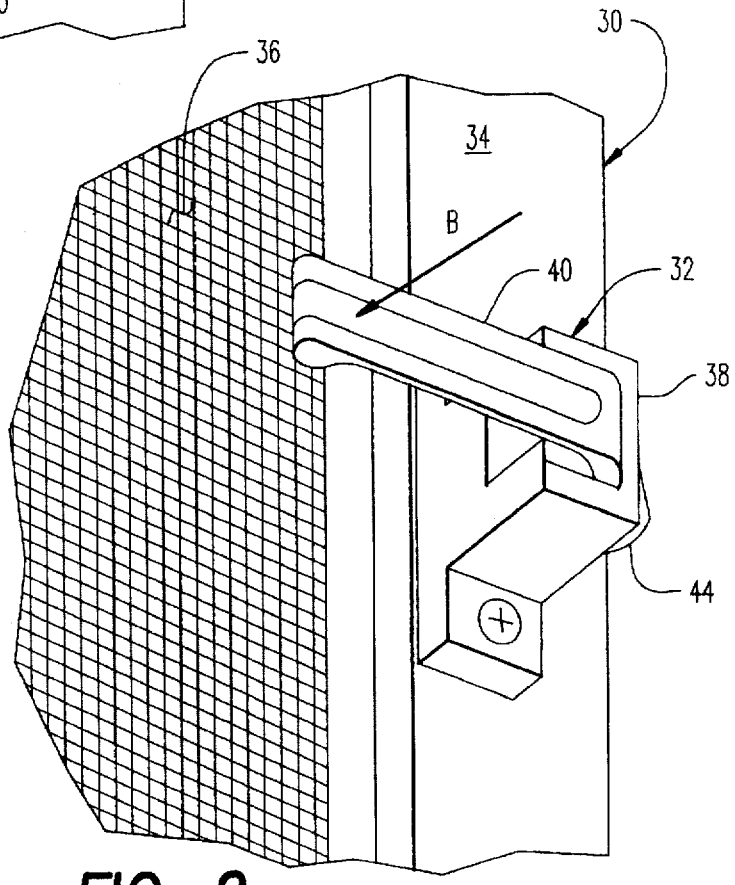
FIG. 2 (PRIOR ART)
FIG. 2 is a broken perspective view of a light-duty door latch assembly similar to that in FIG. 1 connected onto a screen door.

Referring now to the drawings, and particularly to FIGS. 1 and 2, a typical light-duty glass door having an aluminum frame is shown at 10 and includes a conventional light-duty door latch assembly 12 connected onto the door frame 14. The open part of the door assembly 10 is filled with glass 16. The door latch assembly 12 includes a cast aluminum door latch housing 18 onto which is pivotally connected a short door handle 20. When the door handle is pushed inwardly in the direction of arrow A, the latch 22 disengages from a mating cavity in the door frame (not shown).

In FIG. 2, a similar door latch assembly is shown at 32 and is connected onto an upright frame member 34 of a convention light-duty aluminum screen door 30. Again, the open portion of the screen door assembly 30 is filled with screen material 36. This door latch assembly 32 likewise includes a pivotally connected handle 40 which, when pressed in the direction of arrow B near its distal free end, the handle 40 pivots inwardly to disengage latch 42 mounted within door latch housing 38.

Because these typical light-duty door latch assemblies 12 and 32 are formed of inexpensive cast aluminum or even "pot metal" and because the interior mating components are usually not machined, but rather used in substantially in as "as cast" configuration, the transferal of movement and force from the pivoted handle 20 or 40 is many times uneven and of high friction characteristics. As a result, a substantially higher force against the distal end of the handle to effect opening is required.

The invention is shown positioned in FIG. 3 which depicts the same door assembly 10 and door latch assembly 12 as described with respect to FIG. 1. A handle extension 24 in the form of an elongated semi-flexible reinforced rubber tube is urged in the direction of arrow E onto full engagement over handle 20 as shown. The length of this handle extension 24 is at least twice that of the handle 20 and is sized in diameter so as to be snugly urged onto the handle 20 in the direction of arrow E and be self-retaining by the natural biasing of the extension handle 24 in that stretched and deformed position.

Handle extension 24 thus facilitates opening of the door latch assembly 12 through the pivotal motion of handle 20 when a manual force is exerted in the direction of arrow C near the distal end of the handle extension 24. The force is multiplied in proportion to the ratio of length of the handle extension 24 to that of the handle 20 itself.

Note in FIG. 3 that the material stiffness and dimensions of the handle extension 24 are chosen such that limited resilience is afforded to prevent the handle extension 24 from flexing sufficiently to contact the glass panel 16 as shown in phantom. Yet, sufficient resilience and concealment of substantially all of the handle 20 are provided so that, in the event of an inadvertent impact or bumping or hitting of the handle extension 24 with a part of the body such as a hip, leg or arm, the potential tissue injury is substantially reduced from that which may be inflicted by direct contact with rigid handle 20 in FIG. 1.

FIG. 4 is similar to that of FIG. 2 except with the addition of the semi-flexible handle extension 42, which has been slidably and forcibly engaged over the pivoted handle 40. Interengagement between the handle 40 and the semi-flexible handle extension 42 is best seen in FIG. 5.

When the distal end of the handle extension 42 is urged into pivotal movement in the direction of arrow D, handle 40 pivots within door latch housing 38 to disengage the latch 44 from the door jam (not shown). Here, again, as with respect to FIG. 3, the handle extension 42 is preferably formed of reinforced tubular rubber material or stock having sufficient stiffness so as to prevent or resist contact of the distal end of the handle extension 42 with screen 36 when the lever 40 is pushed to open the door latch assembly 32, and yet sufficiently resilient so as to resiliently deflect when accidentally bumped, impacted or struck by a body part of an individual such as a hip, waist, hand, arm or leg.

Examples of embodiments of the invention have been herein described with respect to a door latch assembly having a pivotal handle which pivots inwardly toward the door assembly to effect opening. Nonetheless the invention is equally applicable to light-duty door latch assemblies which include a downwardly or upwardly pivoted handle of the nature hereinabove described to effect opening of such a light-duty door latch assembly.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A handle extension for a light-duty door latch assembly of a screen door having a handle pivotally connected at one end thereof to the door latch assembly, said handle extension consisting of:

an elongated flexible tube having a flexible, smooth substantially cylindrical outer side wall and a smooth inner surface defining a diameter for being sized with respect to a cross sectional shape of the handle to require elastic stretching and deforming of one end of said flexible tube over said handle;

said flexible tube for being substantially longer in length than a length of said handle whereby a manual force required to unlatch said door latch assembly is substantially reduced;

said flexible tube including inherent flexure means for elastically bending when a distal portion thereof is bumped or struck by an individual, yet providing sufficient stiffness to pivotally move said handle to unlatch said door latch assembly.

2. In combination, a light duty door latch assembly for a screen door and a flexible handle extension for increasing leverage of manually applied force to unlatch said latch assembly, comprising:

a door latch housing having a handle pivotally connected at one end thereof to said door latch housing, said handle operably connected within said door latch housing for unlatching said door latch assembly when pivoted;

an elongated flexible tube sized with respect to an inner surface thereof for biased retaining engagement over substantially all of said handle;

said flexible tube having a length at least twice a length of said handle whereby a force required to unlatch said door latch assembly is reduced substantially;

a distal portion of said flexible tube unsupported by said handle having inherent means for substantially resiliently deflecting upon body impact when accidentally bumped or struck by an individual, yet having sufficient stiffness for pivotally moving said handle to unlatch said door latch assembly without substantial contact with the screen door.

* * * * *